US005476571A

United States Patent [19]

Diaz

[11] Patent Number: 5,476,571

[45] Date of Patent: Dec. 19, 1995

[54] THREE-SPEED POWERED SHEETROCK TAPING APPARATUS

[76] Inventor: Josue Diaz, 545 Augustine St., Uvalde, Tex. 78801

[21] Appl. No.: 393,194

[22] Filed: Feb. 23, 1995

[51] Int. Cl.[6] ..... B32B 31/00

[52] U.S. Cl. ..... 156/577; 156/523; 156/579

[58] Field of Search ..... 156/523, 524, 156/526, 527, 531, 574, 575, 576, 577, 578, 579

[56] References Cited

U.S. PATENT DOCUMENTS

| | | | |
|---|---|---|---|
| 2,815,142 | 12/1957 | Ames | 156/575 X |
| 3,960,643 | 6/1976 | Dargitz et al. | 156/575 X |
| 4,750,968 | 6/1988 | Sweeny | 156/577 X |
| 5,279,700 | 1/1994 | Retti | 156/578 |

*Primary Examiner*—James Engel

[57] ABSTRACT

A three-speed powered sheetrock taping apparatus comprised of an elongated hollow pole having a battery chamber formed therein. A trigger mechanism is pivotally secured to the elongated hollow pole. The trigger mechanism has a pressure activated toggle switch theresecured. The toggle switch extends inwardly of the elongated hollow pole. A power switch is secured within the elongated hollow pole opposing the trigger mechanism. The power switch is coupled to the pressure activated toggle switch of the trigger mechanism. The power switch has a wire coupled with the battery chamber. A securement means for a roll of drywall tape is secured to the elongated hollow pole upwardly of the trigger mechanism. A motor is secured within an open end of the elongated hollow pole. The motor has a gear theresecured extending outwardly of the open end of the elongated hollow pole. A roller bracket is secured to the open end of the elongated hollow pole. The roller bracket has a rotating gear shaft with rollers rotatably secured therein. The rotating gear shaft is coupled with the gear of the motor. The roller bracket has a large roller secured on a roller shaft therein above the rotating gear shaft with rollers.

6 Claims, 4 Drawing Sheets

THREE-SPEED POWERED SHEETROCK TAPING APPARATUS

BACKGROUND OF THE INVENTION

1. Field of the Invention

The present invention relates to a three-speed powered sheetrock taping apparatus and more particularly pertains to applying sheetrock joint tape to any wall or ceiling with a three-speed powered sheetrock taping apparatus.

2. Description of the Prior Art

The use of wallboard tape applicators is known in the prior art. More specifically, wallboard tape applicators heretofore devised and utilized for the purpose of applying wallboard compound and wallboard tape are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,279,700 to Retti discloses an automated wallboard taping apparatus and process therefor.

U.S. Pat. No. 4,775,442 to Januska discloses an applicator for wallboard tape.

U.S. Pat. No. 4,689,107 to Entwistle discloses an applicator for wallboard tape.

U.S. Pat. No. 4,090,914 to Hauk et al. discloses an apparatus for applying tape and adhesive to wallboard joints.

U.S. Pat. No. 3,707,427 to Erickson discloses a dispensing gun for wallboard tape and joint compound.

While these devices fulfill their respective, particular objective and requirements, the aforementioned patents do not describe a three-speed powered sheetrock taping apparatus for applying sheetrock joint tape to any wall or ceiling.

In this respect, the three-speed powered sheetrock taping apparatus according to the present invention substantially departs from the conventional concepts and designs of the prior art, and in doing so provides an apparatus primarily developed for the purpose of applying sheetrock joint tape to any wall or ceiling.

Therefore, it can be appreciated that there exists a continuing need for new and improved three-speed powered sheetrock taping apparatus which can be used for applying sheetrock joint tape to any wall or ceiling. In this regard, the present invention substantially fulfills this need.

SUMMARY OF THE INVENTION

In view of the foregoing disadvantages inherent in the known types of wallboard tape applicators now present in the prior art, the present invention provides an improved three-speed powered sheetrock taping apparatus. As such, the general purpose of the present invention, which will be described subsequently in greater detail, is to provide a new and improved three-speed powered sheetrock taping apparatus and method which has all the advantages of the prior art and none of the disadvantages.

To attain this, the present invention essentially comprises an elongated hollow pole having an open first end, an open second end, and an intermediate extent therebetween. The open first end has a battery chamber formed therein. The open first end is internally threaded. The pole has a removable threaded cap with a spring adapted to secure a battery within the battery chamber of the open first end. The device contains a trigger mechanism having a first end and a second end. The first end is pivotally secured to the intermediate extent of the elongated hollow pole. The second end has a pressure activated toggle switch theresecured. The toggle switch extends inwardly of the elongated hollow pole. A three-speed switch is secured within the intermediate extent of the elongated hollow pole opposing the trigger mechanism. The three-speed switch is coupled to the pressure activated toggle switch of the trigger mechanism. The three-speed switch has a lower wire having a first end and a second end. The first end is coupled with the battery chamber. The second end is coupled with the three-speed switch. The device contains a pair of tape brackets. Each of the tape brackets has a first end and a second end. Each first end is secured to the intermediate extent of the elongated hollow pole upwardly of the trigger mechanism. Each second end has an aperture formed therethrough. Each second end is adapted to receive a roll of drywall tape therein and secured by a threaded rod between the apertures thereof. A plurality of tape guides are secured to the intermediate extent of the elongated hollow pole spaced intermittently upward of the pair of tape brackets. The tape guides serve to lead the drywall tape upwardly from the two tape brackets. A motor is secured within the open second end of the elongated hollow pole. The motor has a first wire extending downwardly to couple with the three-speed switch. The motor has a second wire extending downwardly to couple with the battery chamber. The motor has a gear theresecured extending outwardly of the open second end of the elongated hollow pole. A roller bracket is secured to the open second end of the elongated hollow pole. The roller bracket has a rotating gear shaft with rollers rotatably secured therein. The rotating gear shaft is coupled with the gear of the motor. The roller bracket has a large roller secured on a roller shaft therein above the rotating gear shaft with rollers. The device contains a cutter blade having a lower end and an upper end. The lower end is secured to the open second end of the elongated hollow pole. The upper end extends upwardly to a point intermediate of the large roller. The upper end has a cutting surface thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which thins disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved three-speed powered sheetrock taping apparatus which has all the advantages of the prior art wallboard tape applicators and none of the disadvantages.

It is another object of the present invention to provide a new and improved three-speed powered sheetrock taping apparatus which may be easily and efficiently manufactured and marketed.

It is a further object of the present invention to provide a new and improved three-speed powered sheetrock taping apparatus which is of durable and reliable construction.

An even further object of the present invention is to provide a new and improved three-speed powered sheetrock taping apparatus which is susceptible of a low cost of manufacture with regard to both materials and labor, and which accordingly is then susceptible of low prices of sale to the consuming public, thereby making such a three-speed powered sheetrock taping apparatus economically available to the buying public.

Still yet another object of the present invention is to provide a new and improved three-speed powered sheetrock taping apparatus which provides in the apparatuses and methods of the prior art some of the advantages thereof, while simultaneously overcoming some of the disadvantages normally associated therewith.

Even still another object of the present invention is to provide a new and improved three-speed powered sheetrock taping apparatus for applying I sheetrock joint tape to any wall or ceiling.

Lastly, it is an object of the present invention to provide a new and improved three-speed powered sheetrock taping apparatus comprised of an elongated hollow pole having a battery chamber formed therein. A trigger mechanism is pivotally secured to the elongated hollow pole. The trigger mechanism has a pressure activated toggle switch theresecured. The toggle switch extends inwardly of the elongated hollow pole. A power switch is secured within the elongated hollow pole opposing the trigger mechanism. The power switch is coupled to the pressure activated toggle switch of the trigger mechanism. The power switch has a wire coupled with the battery chamber. A securement means for a roll of drywall tape is secured to the elongated hollow pole upwardly of the trigger mechanism. A motor is secured within an open end of the elongated hollow pole. The motor has a first wire extending downwardly to couple with the power switch. The motor has a second wire extending downwardly to couple with the battery chamber. The motor has a gear theresecured extending outwardly of the open end of the elongated hollow pole. A roller bracket is secured to the open end of the elongated hollow pole. The roller bracket has a rotating gear shaft with rollers rotatably secured therein. The rotating gear shaft is coupled with the gear of the motor. The roller bracket has a large roller secured on a roller shaft therein above the rotating gear shaft with rollers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
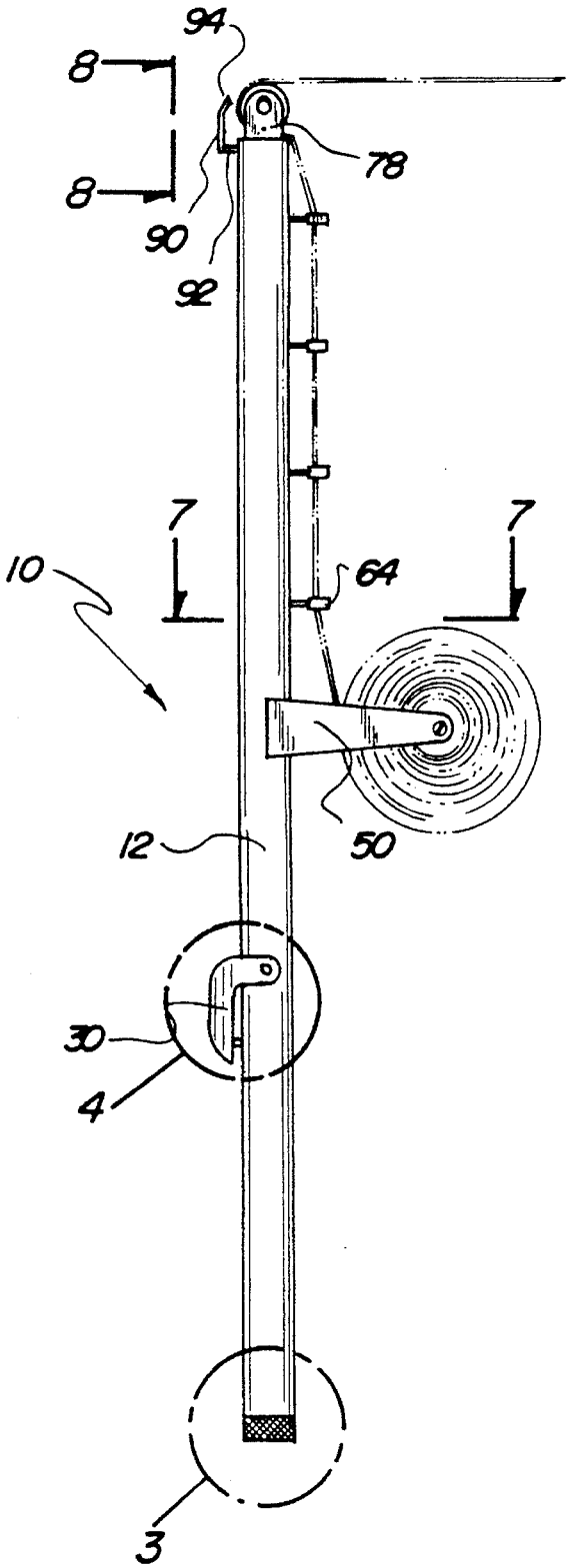
FIG. 1 is a perspective view of the preferred embodiment of the three-speed powered sheetrock taping apparatus constructed in accordance with the principles of the present invention.
Figure 2:
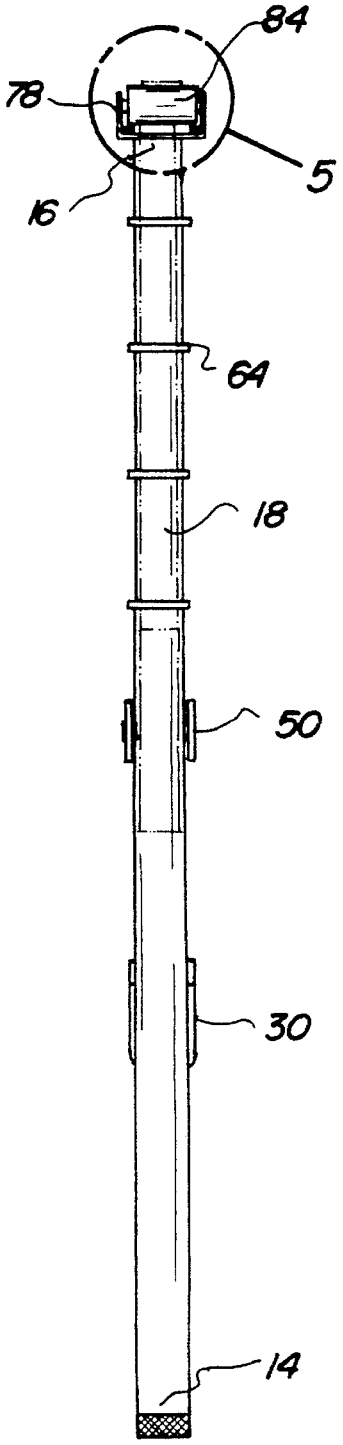
FIG. 2 is a front elevation view of the present invention.
Figure 3:
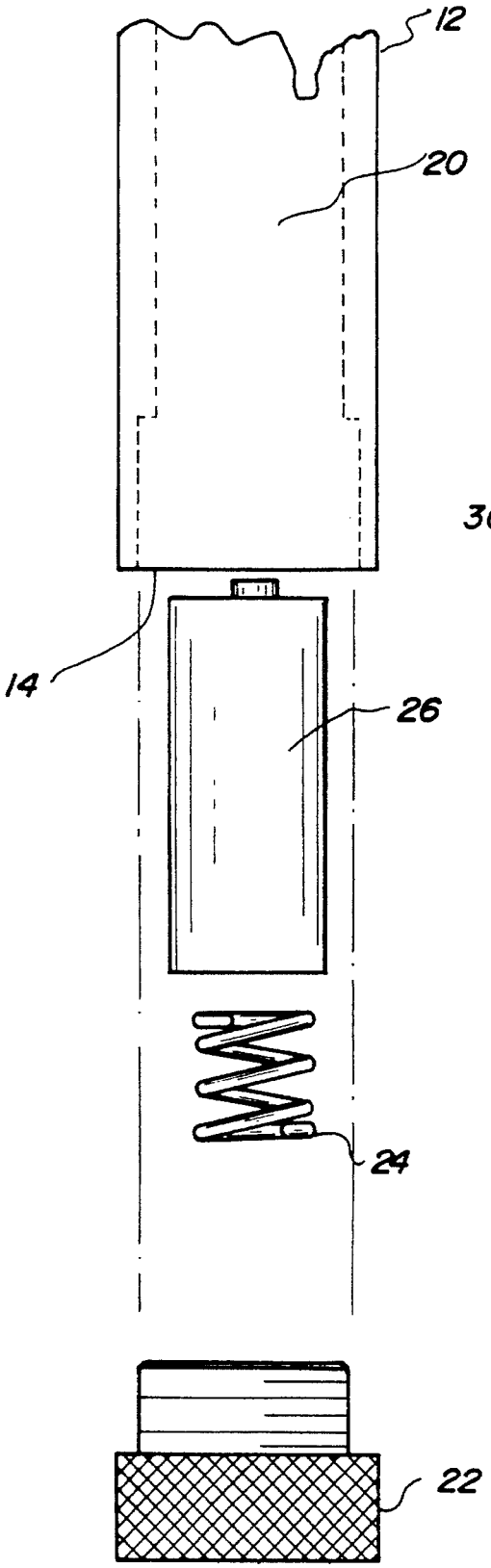
FIG. 3 is an enlarged fragmentary view as taken from FIG. 1.
Figure 4:
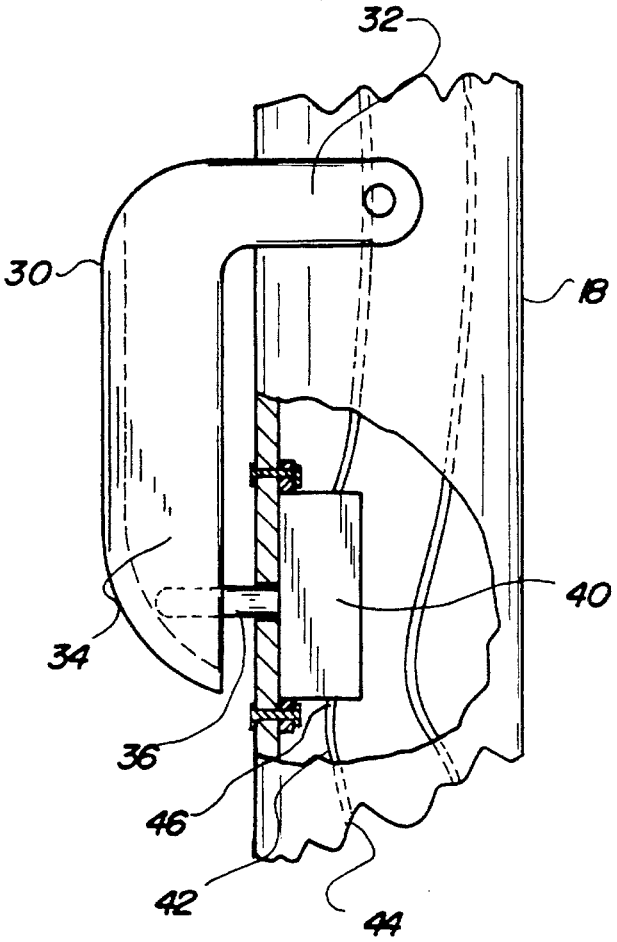
FIG. 4 is an enlarged fragmentary view as taken from FIG. 1.
Figure 5:
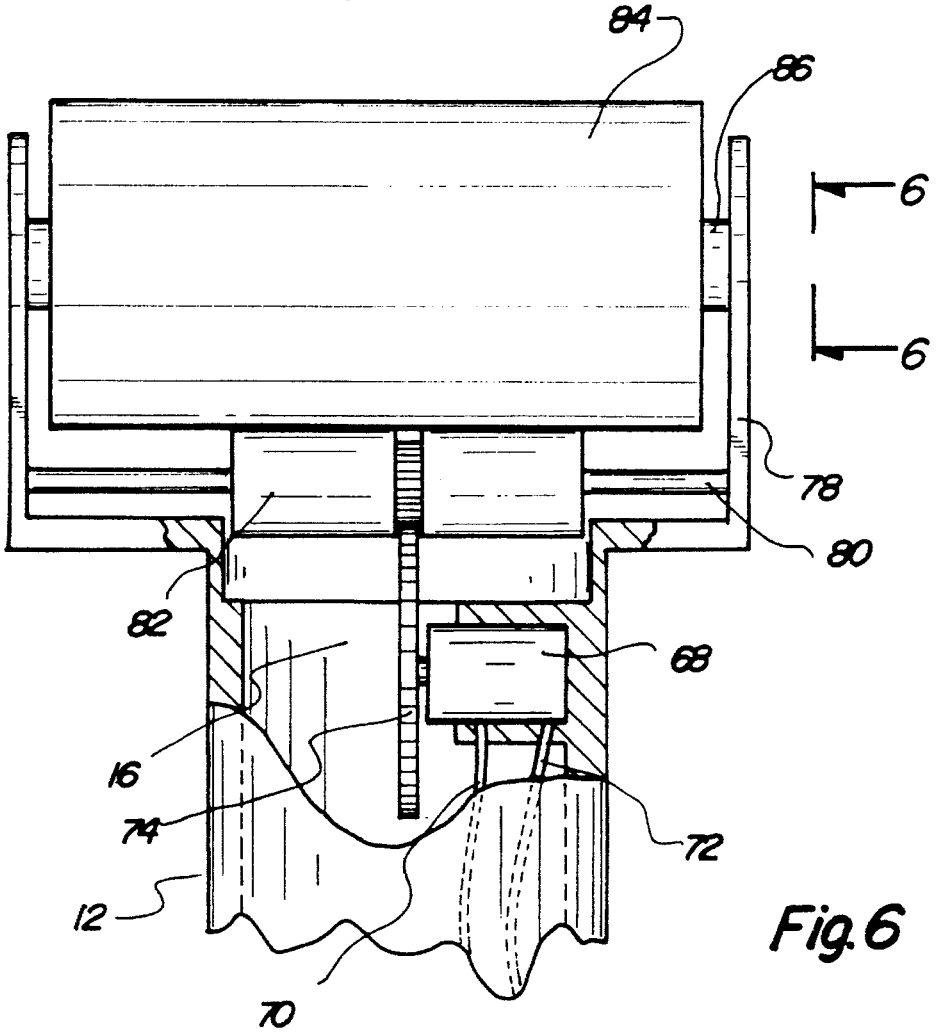
FIG. 5 is an enlarged fragmentary view as taken from FIG. 2.
Figure 6:
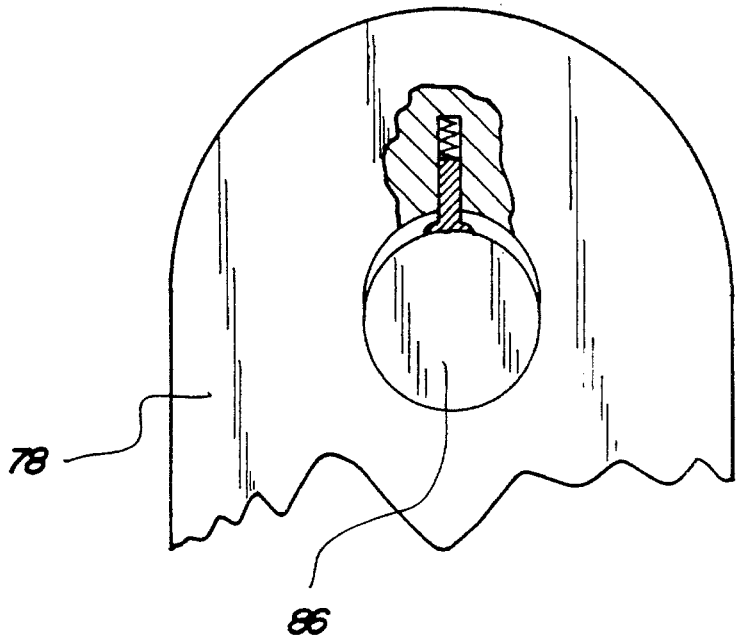
FIG. 6 is a cross-sectional view as taken along line 6—6 of FIG. 5.
Figure 7:
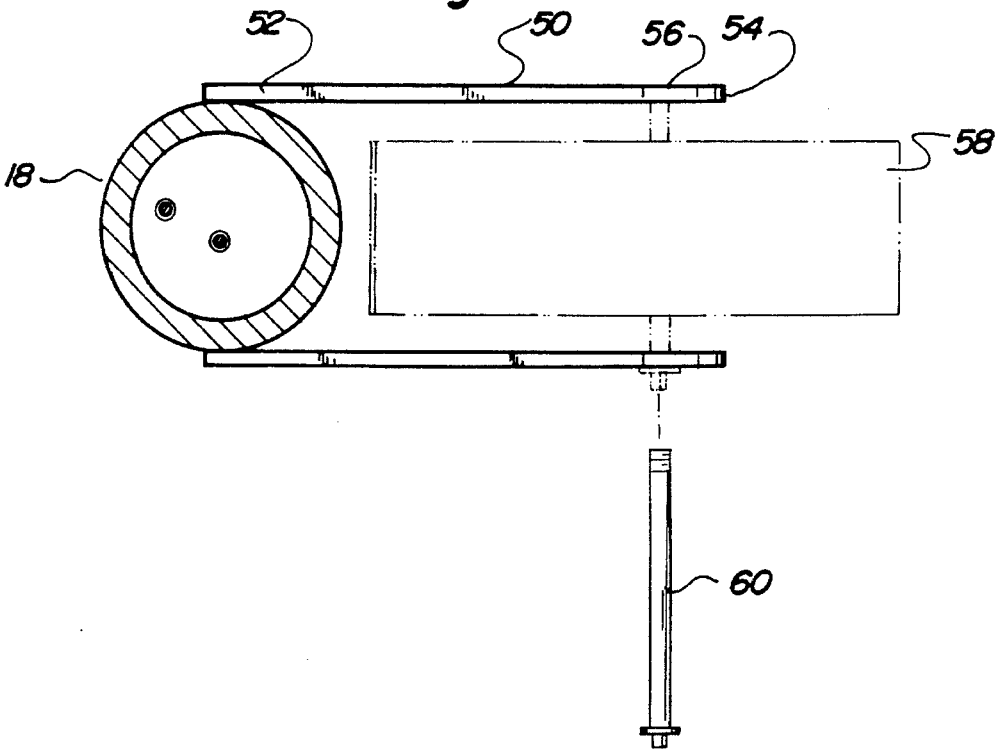
FIG. 7 is a cross-sectional view as taken along line 7—7 of FIG. 1.
Figure 8:
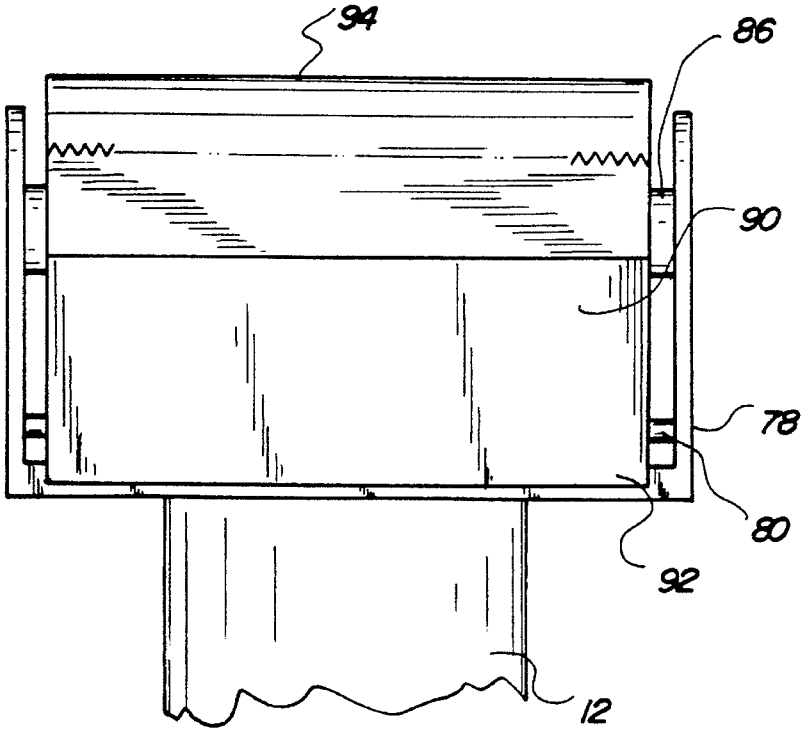
FIG. 8 is a cross-sectional view as taken along line 8—8 of FIG. 1.

With reference now to the drawings, and in particular, to FIG. 1 thereof, the preferred embodiment of the new and improved three-speed powered sheetrock taping apparatus embodying the principles and concepts of the present invention and generally designated by the reference number 10 will be described.

Specifically, it will be noted in the various Figures that the device relates to a new and improved three-speed powered sheetrock taping apparatus for applying sheetrock joint tape to any wall or ceiling. In its broadest context, the device consists of an elongated hollow pole, a trigger mechanism, a three-speed switch, a pair of tape brackets, a plurality of guides, a motor, a roller bracket, and a cutter blade.

The device 10 contains an elongated hollow pole 12 having an open first end 14, an open second end 16, and an intermediate extent 18 therebetween. The open first end 14 has a battery chamber 20 formed therein. The open first end 14 is internally threaded. The pole 12 has a removable threaded cap 22 with a spring 24 adapted to secure a battery 26 within the battery chamber 20 of the open first end 14. The battery chamber 20 would house one D sized battery.

The device 10 contains a trigger mechanism 30 having a first end 32 and a second end 34. The first end 32 is pivotally secured to the intermediate extent 18 of the elongated hollow pole 12. The second end 34 has a pressure activated toggle switch 36 theresecured. The toggle switch 36 extends inwardly of the elongated hollow pole 12.

A three-speed switch 40 is secured within the intermediate extent 18 of the elongated hollow pole 12 opposing the trigger mechanism 30. The three-speed switch 40 is coupled to the pressure activated toggle switch 36 of the trigger mechanism 30. The three-speed switch 40 has a lower wire 42 having a first end 44 and a second end 46. The first end 44 is coupled with the battery chamber 20. The second end 46 is coupled with the three-speed switch 40.

The device 10 contains a pair of tape brackets 50. Each of the tape brackets 50 has a first end 52 and a second end 54. Each first end 52 is secured to the intermediate extent 18 of the elongated hollow pole 12 upwardly of the trigger mechanism 40. Each second end 54 has an aperture 56 formed therethrough. Each second end 54 is adapted to receive a roll of drywall type 58 therein and secured by a threaded rod 60 between the apertures 56 thereof.

A plurality of tape guides 64 are secured to the intermediate extent 18 of the elongated hollow pole 12 spaced intermittently upward of the pair of tape brackets 50. The tape guides 64 serve to lead the drywall tape 58 upwardly from the two tape brackets 50. The preferred amount of tape guides 64 employed by the device 10 is four.

A motor 68 is secured within the open second end 16 of the elongated hollow pole 12. The motor 68 has a first wire 70 extending downwardly to couple with the three-speed switch 40. The motor 68 has a second wire 72 extending downwardly to couple with the battery chamber 20. The motor 68 has a gear 74 theresecured extending outwardly of the open second end 16 of the elongated hollow pole 12.

A roller bracket 78 is secured to the open second end 16 of the elongated hollow pole 12. The roller bracket 78 has a rotating gear shaft 80 with rollers 82 rotatably secured therein. The rotating gear shaft 80 is coupled with the gear 74 of the motor 68. The roller bracket 78 has a large roller 84 secured on a roller shaft 86 therein above the rotating gear shaft 80 with rollers 82. When the motor 68 is activated by the three-speed switch 40, the gear 74 rotates the gear shaft 80 and subsequently the rollers 82 thereby leading drywall tape 58 between the rollers 82 and the large roller 84. This allows the large roller 84 to apply the drywall tape 58 to the desired surfaces without a great effort.

The device 10 contains a cutter blade 90 having a lower end 92 and an upper end 94. The lower end 92 is secured to the open second end 16 of the elongated hollow pole 12. The upper end 94 extends upwardly to a point intermediate of the large roller 84. The upper end 94 has a cutting surface thereon. When the desired amount of drywall tape 58 has been applied, the user can use the cutter blade 90 to neatly cut off any excess drywall tape 90. The cutter blade 90 and the trigger mechanism 30 are disposed on opposite sides of the elongated hollow pole 12 from the pair of tape brackets 50 and the plurality of guides 64.

The present invention is a three-speed powered device 10 for applying sheetrock joint tape that suspends an entire roll of tape from an easily maneuvered pole.

Simply stated, the design consists of a lightweight aluminum pole, a roll clip, a roller head, a trigger, and a cutter blade. The aluminum pole is approximately 4 feet long and is made from 1½ inch diameter aluminum tubing. The clip that suspends the roll of joint tape is located on the pole's shaft, nearer to the roller head than the handle. The area between the head and roller clip is fitted with three to four guides that help to keep the tape in place as it is applied. The roller head is simply a small diameter roller mounted to a suitable bracket. It is positioned directly on top of the aluminum pole. The cutter blade is located on the top of the pole opposite the roller, while the trigger is conveniently situated on the handle.

In use, the tape roll is fastened to the clip, and the tape is fed through the guides to the roller head. With the tape installed, the taping operation can begin. The roller head is used to press the tape onto the surface of the sheetrock, as directed by the person maneuvering the handle. When the desired length of tape has been applied, the cutter blade severs the roll from the tape that is already adhered to the wall.

The present invention helps to ease the task of applying joint tape to any wall or ceiling. Anyone who must install new sheetrock or renovate an existing structure is almost certain to appreciate the advantages of using this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A three-speed powered sheetrock taping apparatus for applying sheetrock joint tape to any wall or ceiling comprising, in combination:

an elongated hollow pole having an open first end, an open second end, and an intermediate extent therebetween, the open first end having a battery chamber formed therein, the open first end being internally threaded, the pole having a removable threaded cap with a spring adapted to secure a battery within the battery chamber of the open first end;

a trigger mechanism having a first end and a second end, the first end pivotally secured to the intermediate extent of the elongated hollow pole, the second end having a pressure activated toggle switch theresecured, the toggle switch extending inwardly of the elongated hollow pole;

a three-speed switch secured within the intermediate extent of the elongated hollow pole opposing the trigger mechanism, the three-speed switch being coupled to the pressure activated toggle switch of the trigger mechanism, the three-speed switch having a lower wire having a first end and a second end, the first end being coupled with the battery chamber, the second end being coupled with the three-speed switch;

a pair of tape brackets, each of the tape brackets having a first end and a second end, each first end secured to the intermediate extent of the elongated hollow pole upwardly of the trigger mechanism, each second end having an aperture formed therethrough, each second end adapted to receive a roll of drywall type therein and secured by a threaded rod between the apertures thereof;

a plurality of tape guides secured to the intermediate extent of the elongated hollow pole spaced intermittently upward of the pair of tape brackets, the tape guides serving to lead the drywall tape upwardly from the two tape brackets;

a motor secured within the open second end of the elongated hollow pole, the motor having a first wire extending downwardly to couple with the three speed switch, the motor having a second wire extending downwardly to couple with the battery chamber, the motor having a gear theresecured extending outwardly of the open second end of the elongated hollow pole;

a roller bracket secured to the open second end of the elongated hollow pole, the roller bracket having a rotating gear shaft with rollers rotatably secured therein, the rotating gear shaft being coupled with the gear of the motor, the roller bracket having a large roller secured on a roller shaft therein above the rotating gear shaft with rollers;

a cutter blade having a lower end and an upper end, the lower end secured to the open second end of the elongated hollow pole, the upper end extending upwardly to a point intermediate of the large roller, the upper end having a cutting surface thereon.

2. A powered sheetrock taping apparatus for applying sheetrock joint tape to any wall or ceiling comprising, in combination:

an elongated hollow pole having a battery chamber formed therein;

a trigger mechanism pivotally secured to the elongated hollow pole, the trigger mechanism having a pressure activated toggle switch theresecured, the toggle switch extending inwardly of the elongated hollow pole;

a power switch secured within the elongated hollow pole opposing the trigger mechanism, the power switch being coupled to the pressure activated toggle switch of the trigger mechanism, the power switch having a wire coupled with the battery chamber;

a securement means for a roll of drywall tape secured to the elongated hollow pole upwardly of the trigger mechanism;

a motor secured within an open end of the elongated hollow pole, the motor having a first wire extending downwardly to couple with the power switch, the motor having a second wire extending downwardly to couple with the battery chamber, the motor having a gear theresecured extending outwardly of the open end of the elongated hollow pole;

a roller bracket secured to the open end of the elongated hollow pole, the roller bracket having a rotating gear shaft with rollers rotatably secured therein, the rotating gear shaft being coupled with the gear of the motor, the roller bracket having a large roller secured on a roller shaft therein above the rotating gear shaft with rollers.

3. The apparatus as described in claim 2 and further including wherein the power switch is a variable speed power switch.

4. The apparatus as described in claim 3 and further including wherein the securement means further comprises a pair of tape brackets, each of the tape brackets having a first end and a second end, each first end secured to the elongated hollow pole upwardly of the trigger mechanism, each second end having an aperture formed therethrough, each second end adapted to receive a roll of drywall type therein and secured by a threaded rod between the apertures thereof.

5. The apparatus as described in claim 4 and further including a plurality of tape guides secured to the elongated hollow pole spaced intermittently upward of the pair of tape brackets, the tape guides serving to lead the drywall tape upwardly from the two tape brackets.

6. The apparatus as described in claim 5 and further including a cutter blade having a lower end and an upper end, the lower end secured to the open second end of the elongated hollow pole, the upper end extending upwardly to a point intermediate of the large roller, the upper end having a cutting surface thereon.

* * * * *